United States Patent [19]

Tahara

[11] 4,198,552

[45] Apr. 15, 1980

[54] KEY OPERATED SWITCH LOCK ASSEMBLY

[75] Inventor: Tooru Tahara, Yokohama, Japan

[73] Assignee: Takigen Seizou Co., Ltd., Tokyo, Japan

[21] Appl. No.: 930,753

[22] Filed: Aug. 2, 1978

[30] Foreign Application Priority Data

Aug. 2, 1977 [JP] Japan ..... 52-102985[U]

[51] Int. Cl.[2] ..... H01H 9/28; H01H 27/06

[52] U.S. Cl. ..... 200/44; 70/434

[58] Field of Search ..... 200/11 D, 11 DA, 11 A, 200/11 C, 14, 42 R, 44; 70/434, 385, 336, 369, 378, 382, 419, 393

[56] References Cited

U.S. PATENT DOCUMENTS

| | | | |
|---|---|---|---|
| 3,385,086 | 5/1968 | Patriquin | 70/434 |
| 3,415,087 | 12/1968 | Kramasz et al. | 70/434 |
| 3,550,410 | 12/1970 | Toepfer | 70/434 |

*Primary Examiner*—Houston S. Bell, Jr.

*Attorney, Agent, or Firm*—Haseltine, Lake & Waters

[57] ABSTRACT

A key operated switch lock assembly comprising one tumbler lock, a plurality of rotary switches, and at least one key. The switches are supported rearward of a lock housing of the lock, and the key has an elongated portion which protrudes rearward of the lock housing. Each switch comprises a base plate having a pair of spaced stationary contacts, a rotary disk having a moving contact, and a casing to receive the disk and the base plate. The elongated key portion has at least one operating projection which can turn the disk. When the disk is rotated through a given angle, the moving contact comes into contact with one of the stationary contacts. The other of the stationary contacts always touches the moving contact. The key operated switch lock assembly is used for controlling the operation of important devices such as an electronic computer and the like.

1 Claim, 36 Drawing Figures

KEY OPERATED SWITCH LOCK ASSEMBLY

FIELD OF THE INVENTION

This invention relates to a key operated switch lock assembly, which is used to prevent unauthorized persons from operating important devices such as an electronic computer, an input or output device and the like, and to identify authorized persons who actually operated the device.

PRIOR ART

The key operated switch lock assembly disclosed in U.S. Pat. No. 3,912,888 comprises one tumbler lock having a lock housing and a rotatable lock plug, a plurality of mechanical switches of micro-switch type, and a key having an elongated portion which protrudes rearward of the plug. Said switches are supported rearward of the housing, actuators of which are disposed in alignment on the same line parallel to the axis of the elongated key portion. Said elongated key portion has at least one operating edge which drives a corresponding actuator to the "ON" position when the key is rotated in a predetermined direction.

In general, micro-switches considerably differ from each other in the travelling angle of the actuator necessary to close the switch, so that it is not easy to get a key operated switch lock assembly of high reliability in using a micro-switch. As all of the switches to be assembled have to be put to the test of the travelling angle, and it is difficult to raise the efficiency of manufacturing of the assembly.

SUMMARY OF THE INVENTION

It is an object of the invention to provide a key operated switch lock assembly of high reliability in which all of the switches predetermined to be closed can be positively closed in response to a given rotation of the key. Another object of the invention is to raise the manufacturing efficiency of the key operated switch lock assembly.

Other objects and advantages of the invention will be apparent from a consideration of the following detailed description. A preferred embodiment of the invention is illustrated in the accompanying drawings.

DETAILED DESCRIPTION

Figure 16:
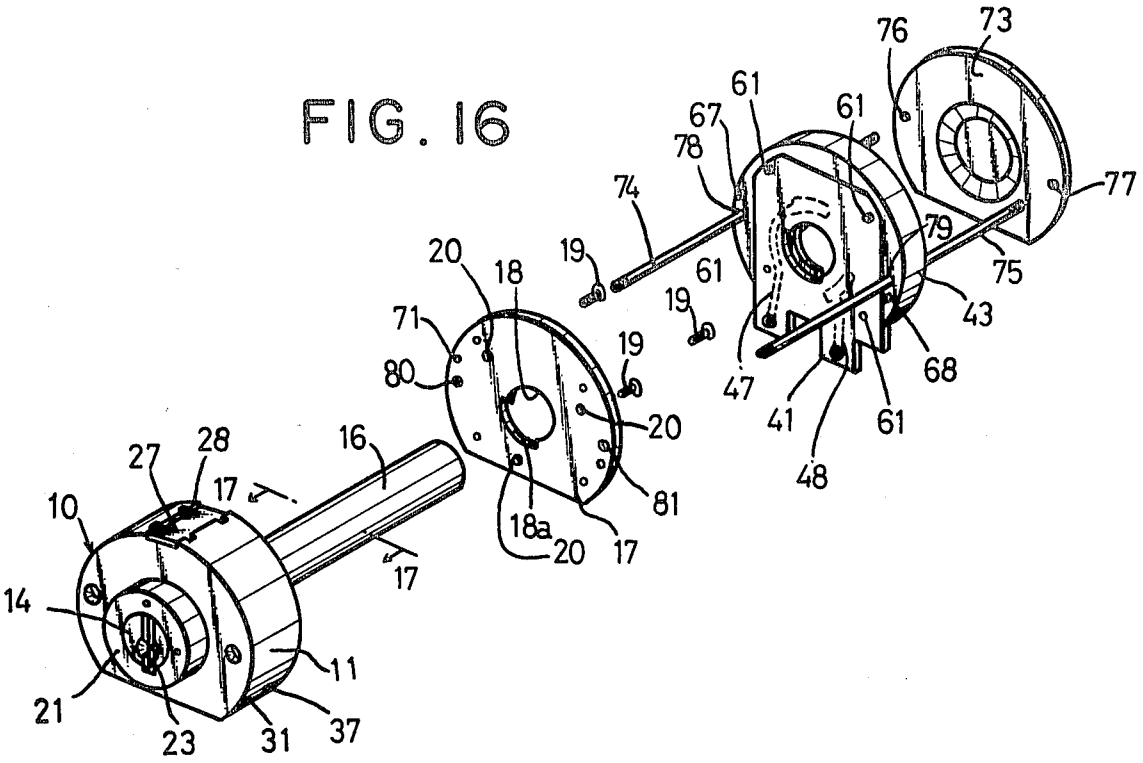
FIG. 16 is a perspective view of main parts of the assembly.
Figure 17:
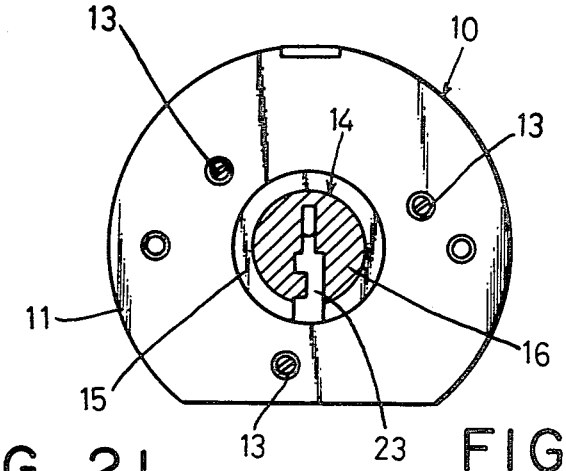
FIG. 17 is a sectional view taken on line 17—17 in FIG. 16.
Figure 21:
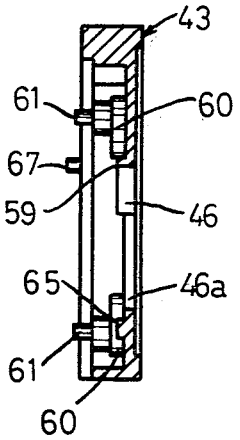
FIG. 21 is a sectional view taken on line 21—21 in FIG. 19.
Figure 22:
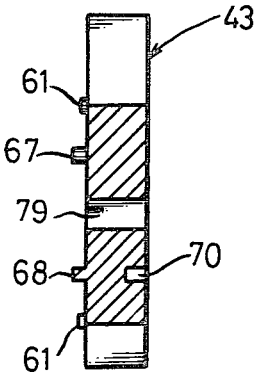
FIG. 22 is a sectional view taken on line 22—22 in FIG. 19.
Figure 23:
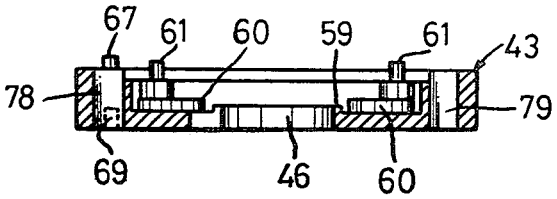
FIG. 23 is a sectional view taken on line 23—23 in FIG. 19.

In FIGS. 1 to 9, there is shown a key operated switch lock assembly, which comprises one tumbler lock 10, a plurality of rotary switches 40 and with at least one key 29. A lock housing 11 is provided with an axial bore 12, and three tapped apertures 13 in its back face as shown in FIG. 17. A lock plug 14 is composed of an enlarged body 15 and an elongated portion 16. The plug body 15 is cylindrical and extends along the entire length of the housing 11 within the axial bore 12. The elongated plug portion 16 is also cylindrical and protrudes rearwardly of the housing 11. A support plate 17 having a central aperture 18 is fixed to the housing 11 by three screws 19 passing through apertures 20 in the plate 17 and threaded into tapped apertures 13. The support plate 17 is best shown in FIG. 16. The elongated plug portion 16 passes through the central aperture 18. The plug body 15 abuts against the support plate 17 and against a forwardmost shoulder portion 21 of the axial bore 12.

The housing 11 and the plug body 15 are provided with a series of locking bores 22 each having a bore extending radially of the housing 11, and, in the plug body 15 intersecting an axial key way 23, a radial bore registrable with the bore in the housing. In each of the bores 22 are a pair of driver and follower tumblers or pins 24, 25, respectively, the pairs of pins being biassed radially towards the keyway 23 by a driver spring 26. One end of each of the driver springs 26 bears against a follower pin 25, the opposite end of the springs bearing against a cover plate 27 set within an undercut groove 28 formed in the housing 11.

Figure 14:
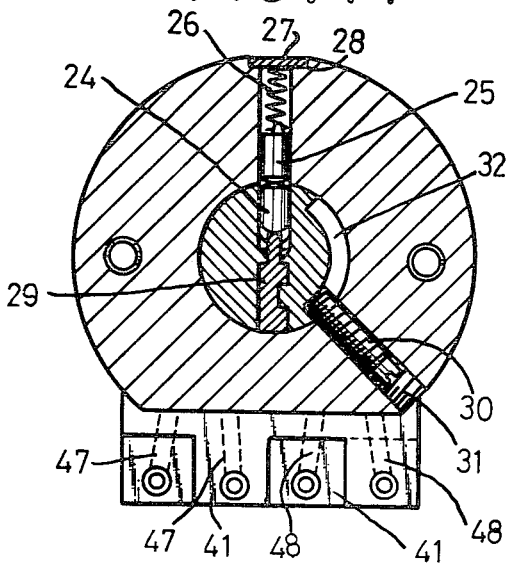
FIG. 14 is a sectional view taken on line 14—14 in FIG. 9.
Figure 15:
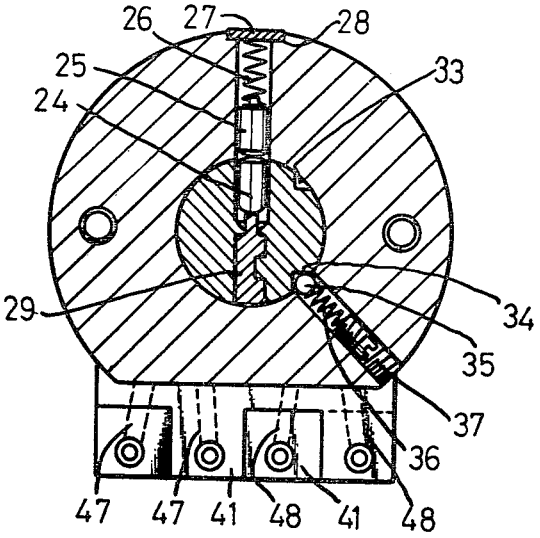
FIG. 15 is a sectional view taken on the line 15—15 in FIG. 9.

It will thus be seen that the locking bores 22, pins 24, 25 and springs 26 act in conventional manner to lock the plug 14 against rotation. A properly bitted key 29 will raise these pins to the shear line defined between the housing and the plug body 15 and, in this position, will permit rotary movement of the plug 14. The rotary movement is restricted within a angle of 90° by a set screw 30 passing through an tapped aperture 31 in the housing 11 and extending into a peripheral groove 32 formed in the plug body 15 as shown in FIG. 14. A detent for the plug 14 is composed of a pair of spaced notches 33, 34 formed in the plug body 15 and a small ball 35 biassed by a coil spring 36 which is carried within a radial bore 37 formed in the housing 11 as shown in FIG. 15.

Figure 1:
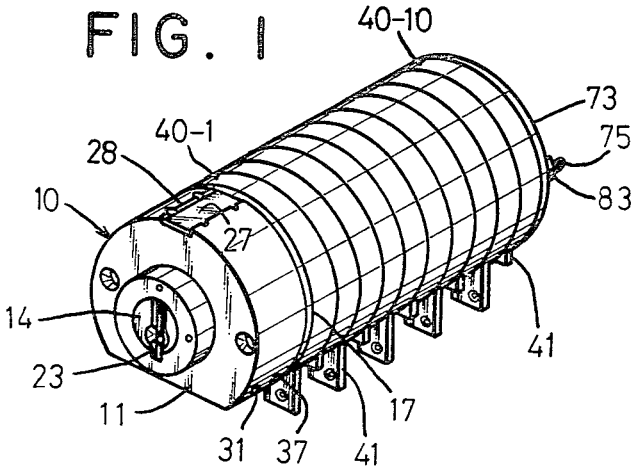
FIG. 1 is a perspective view of a key operated switch lock assembly in accordance with the invention.
Figure 2:
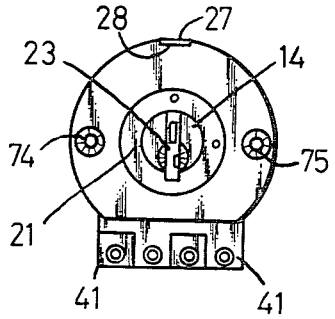
FIG. 2 is a front view of the assembly.
Figure 3:
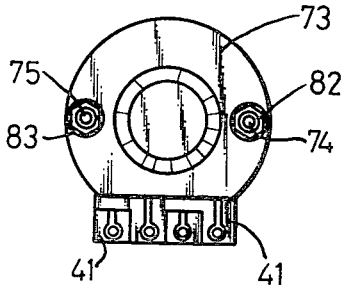
FIG. 3 is a rear view of the assembly.
Figure 4:
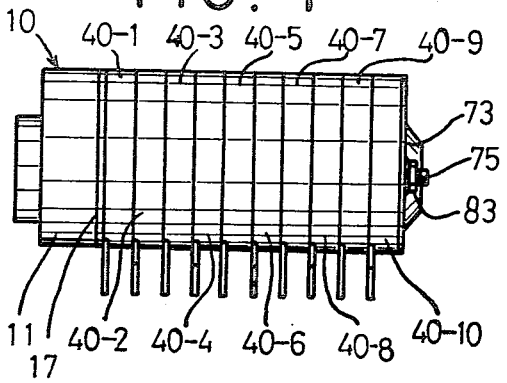
FIG. 4 is a right side view of the assembly.
Figure 5:
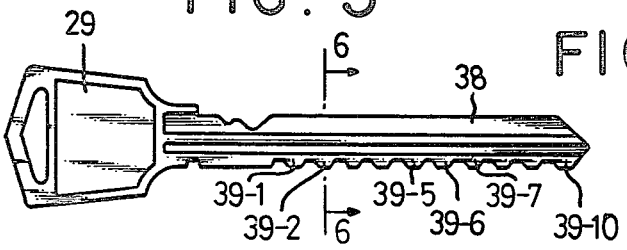
FIG. 5 is a right side view of a key to be used in the assembly.

The key 29 has an elongated portion 38 which extends along subatantially the entire length of the elongated plug portion 16. The elongated key portion 38 of the key of FIG. 5 is provided with ten operating projections 39 in its longitudinal side edge which protrudes out of the lower opening of the keyway 23. On the contrary, the elongated key portion 38 of the key 29 of FIG. 6 has only eight operating projection 39. Namely, in the case of the key 29 of FIG. 6, the second projection 39-2 and the sixth projection 39-6 of the key of FIG. 5 are eliminated wholly.

Figure 18:
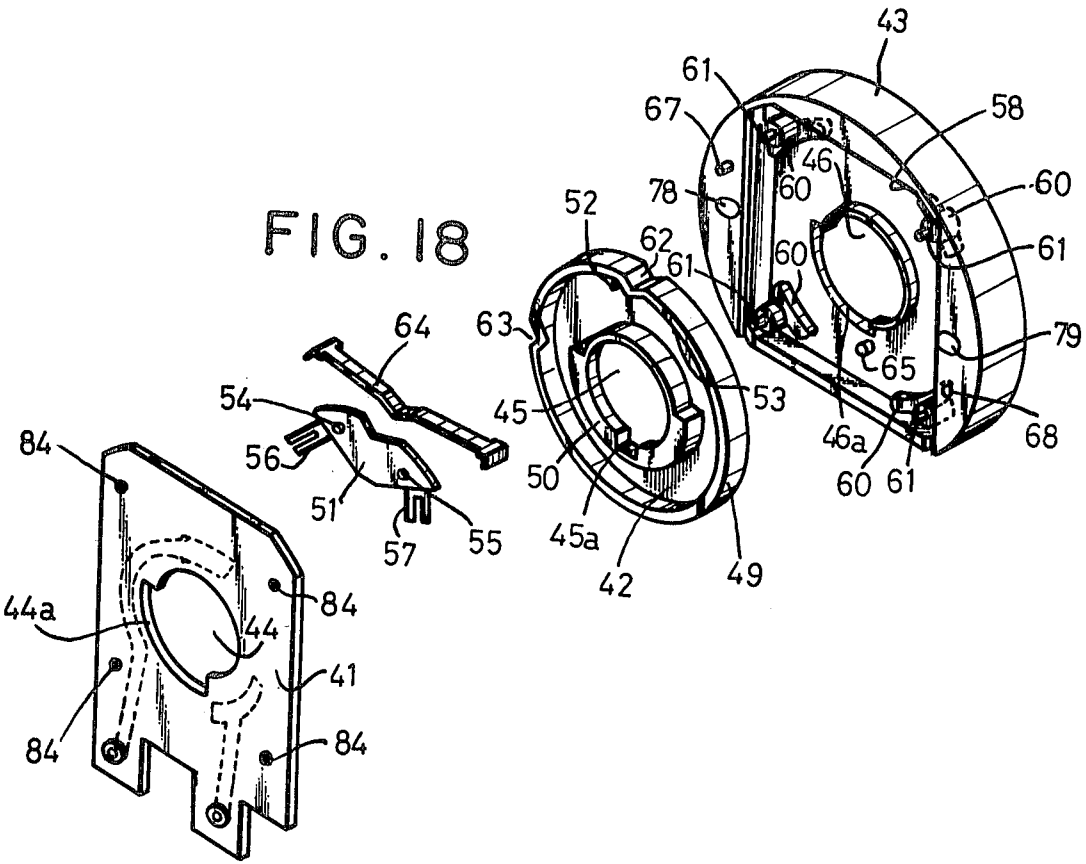
FIG. 18 is a perspective view of parts of a switch to be used in the assembly.
Figure 19:
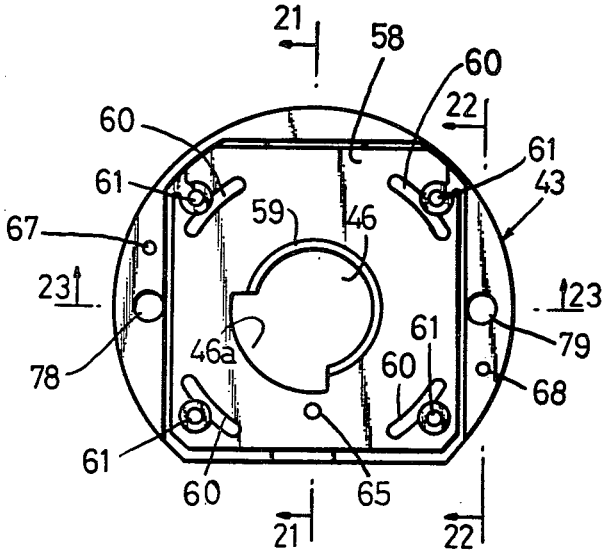
FIG. 19 is a front view of a casing of the switch.
Figure 20:
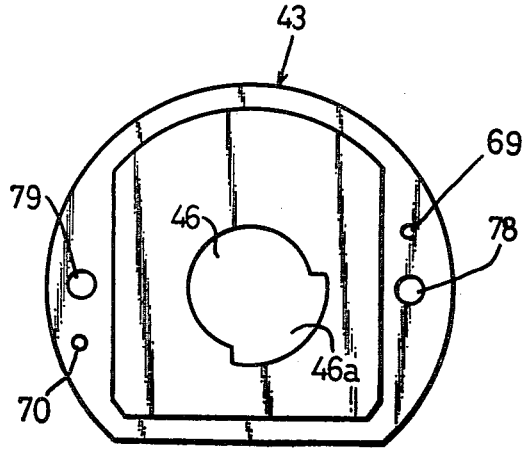
FIG. 20 is a rear view of the casing.
Figure 24:
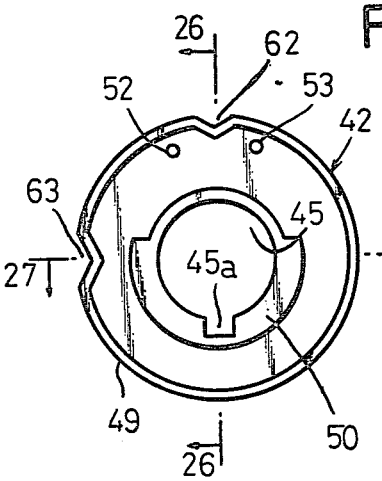
FIG. 24 is a front view of a rotary disk of the switch.
Figure 26:
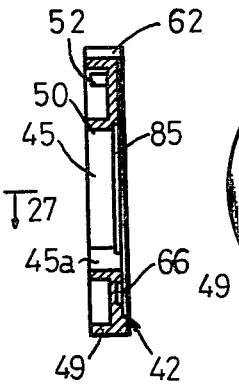
FIG. 26 is a sectional view taken on line 26—26 in FIG. 24.
Figure 25:
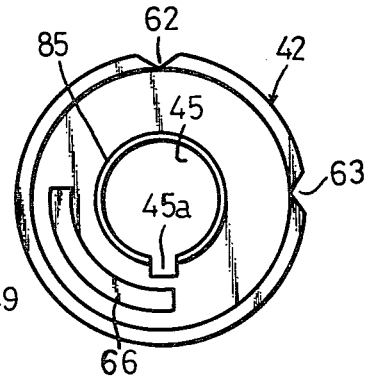
FIG. 25 is a rear view of the disk.
Figure 27:
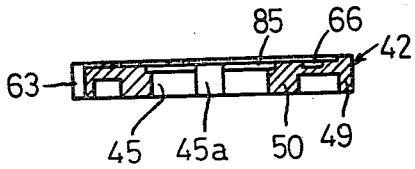
FIG. 27 is a sectional view taken on line 27—27 in FIG. 24.
Figure 28:
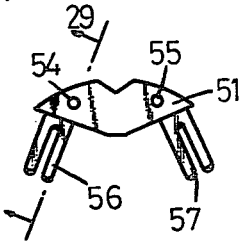
FIG. 28 is a front view of a moving contact of the switch to be attached to the disk.
Figure 29:
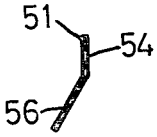
FIG. 29 is a sectional view taken on line 29—29 in FIG. 28.
Figure 30:
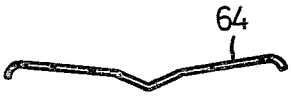
FIG. 30 is a front view of a leaf spring to be interposed between the disk and the casing.
Figure 31:
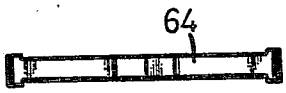
FIG. 31 is a bottom view of the leaf spring.
Figure 32:
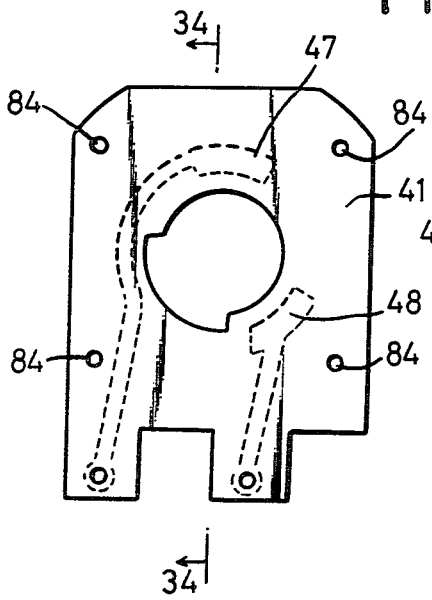
FIG. 32 is a front view of a base plate of the switch.
Figure 34:
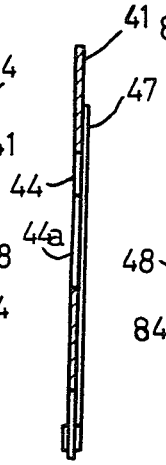
FIG. 34 is a sectional view taken on line 34—34 in FIG. 32.
Figure 33:
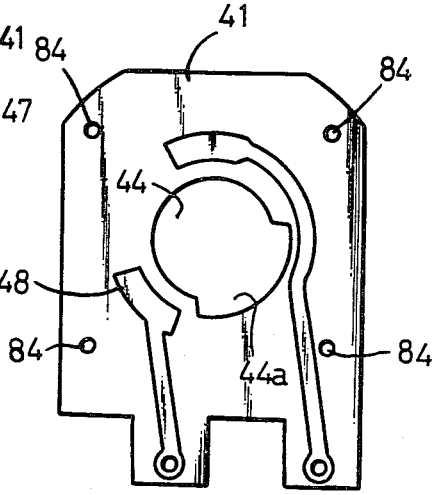
FIG. 33 is a rear view of the base plate having a pair of stationary contacts.

Referring to FIGS. 16 and 18, the rotary switch 40 comprises a base plate 41, a rotary disk 42 and a casing 43 all of which are made of insulative material and central apertures 44, 45 and 46 respectively. The apertures 44, 45 and 46 are sized to be rotatably seated on the elongated plug portion 16. The aperture 18 of the support plate 17 and the apertures 44, 46 have a sectorial cutout **18*a*, 44*a* and 46*a* so as to permit free or useless movement of the operating projection 39, while the aperture 45 has a groove 45*a* into which the operating projection 39 is fitted without any free space to permit the useless movement of the projection 39. The base plate 41 is provided with a pair of spaced stationary contacts 47, 48 on its rear face, which are disposed coaxially with the central aperture 44. The disk 42 is provided with an outer circular flange 49 and an inner circular flange 50 which surround the central aperture 45. A moving contact 51 disposed between the outer and inner flanges 49, 50 is fixed to the front face of the disk 42 by upsetting a pair of rivet bosses 52, 53 passing through small apertures 54, 55**.

A pair of spaced resilent tongues 56, 57 of the moving contact 51 extend obliquely towards the base plate 41. The tongue 57 always touches the stationary contact 47. The tongue 56 selectively touches the stationary contact 48 or the rear face of the base plate 41 in accordance with the rotation position of the disk 42. The casing has a rectangular cavity 58 to receive the disk 42. The cavity is provided with a semi-annular guide lug 59 which surrounds the central aperture 46, and four arched guide lugs 60 in its bottom face. The outer circular flange 49 of the disk 42 abuts against the lug 60 rotatably. The disk 42 is provided with an annular recess 85 on the inner edge of the aperture 45 to receive the semi-annular guide lug 59. The base plate 41 is also received in the cavity 58, and is fixed to the casing 43 by upsetting four rivet bosses 61 passing through small apertures 84 formed in the plate 41. A detent for the rotary disk 42 is composed of a pair of spaced recesses 62, 63 formed on the flange 49 and a leaf spring 64 interposed between the flange 49 and the inner wall of the cavity 58. The rotation range of the disk 42 is restricted within an angle of 90° by stopper boss 65 in the casing 43 extending into a guide recess 66 formed in the rear face of the disk 42. The casing 43 is provided with a pair of diametrically spaced location bosses 67, 68 on its front face, and a pair of diametrically spaced location holes 69, 70 on its rear face which are registrable with the bosses 67, 68 respectively.

Figure 9:
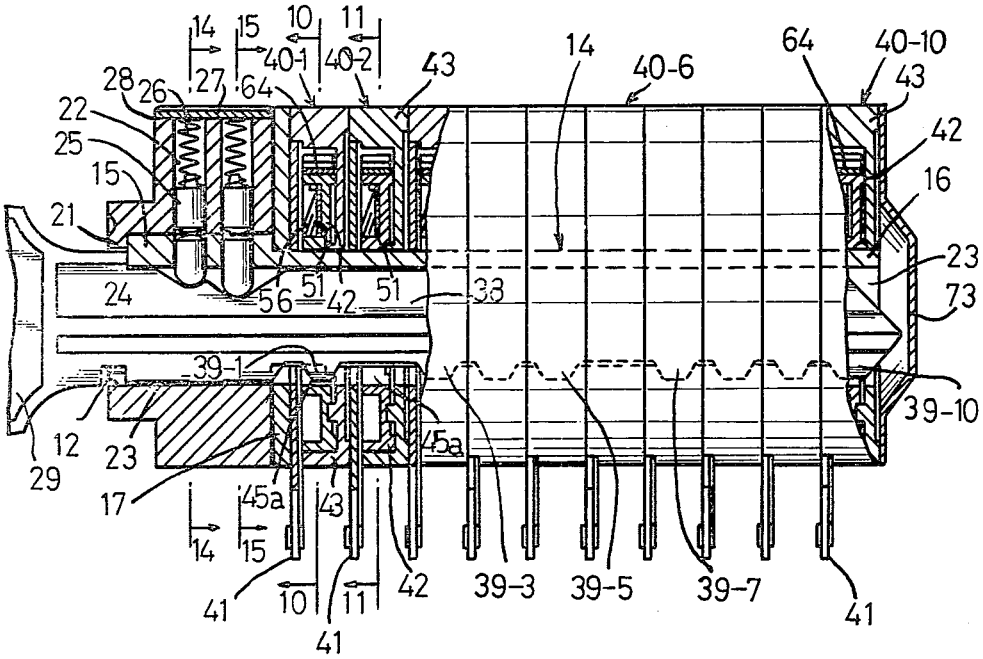
FIG. 9 is a magnified vertical sectional view of the assembly in which the key of FIG. 7 is used.

The rotary switches 40 are stacked in side-by-side position on the elongated plug portion 16 with the location bosses 67, 68 into the location holes 69, 70. The location bosses 67, 68 of the forwardmost or first switch 40-1 are fitted into a pair of location holes 71, 72 formed in the support plate 17. An end plate 73 is abutted against the rearmost or tenth switch 40-10 as shown in FIG. 9. A pair of connecting rods 74, 75 are inserted into small apertures 78, 79 formed in each casing 43 from small apertures 76, 77 formed in the end plate 73. The forwardmost ends of the rods 74, 75 are threaded into a pair of tapped apertures 80, 81 formed in the support plate 17, and a pair of nuts 82, 83 are threaded on the rearmost ends of the rods 74, 75 so as to fix the stacked switches to the support plate 17.

Figure 6:
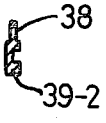
FIG. 6 is a sectional view taken on line 6—6 in FIG. 5.
Figure 7:
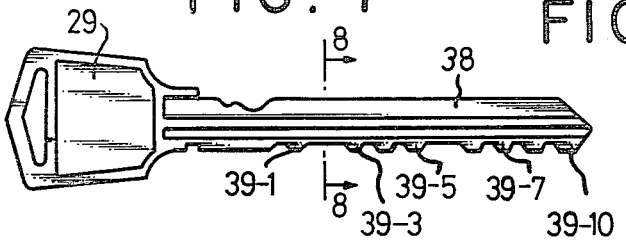
FIG. 7 is a right side view of a key of other form to be used in the assembly.
Figure 8:
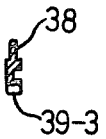
FIG. 8 is a sectional view taken on line 8—8 in FIG. 7.
Figure 10:
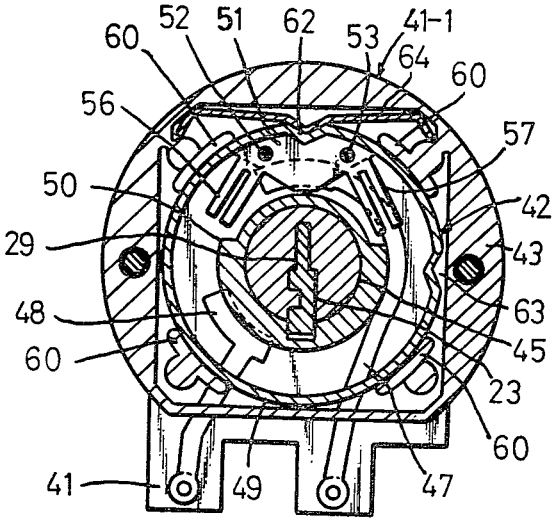
FIG. 10 is a sectional view taken on line 10—10 in FIG. 9.
Figure 11:
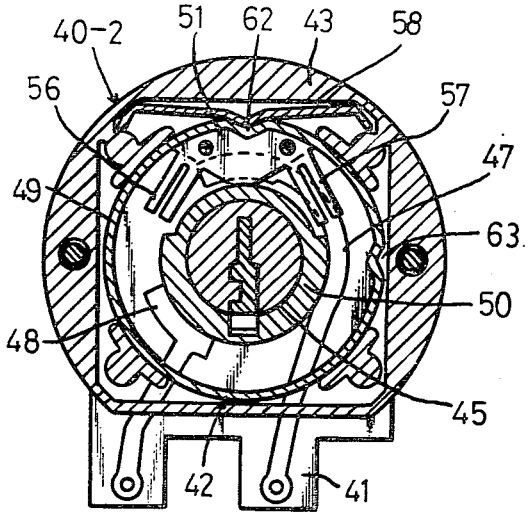
FIG. 11 is a sectional view taken on line 11—11 in FIG. 9.
Figure 12:
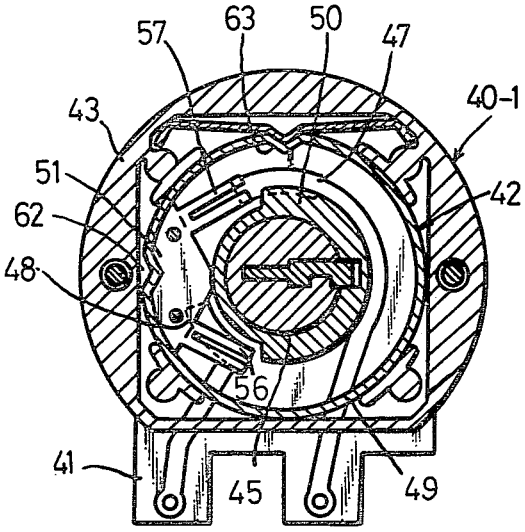
FIG. 12 is a view similar to FIG. 10, showing the parts after rotation of the key.
Figure 13:
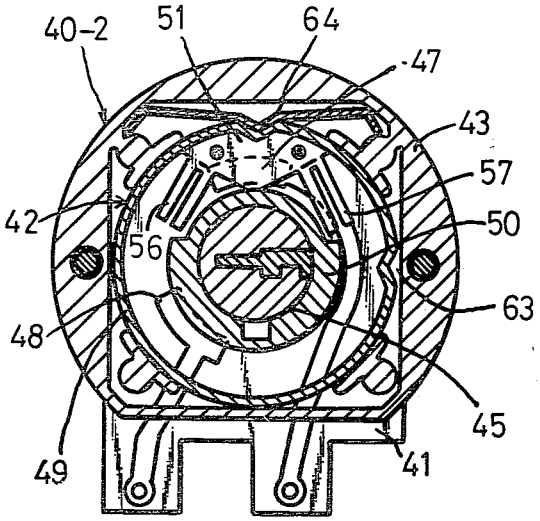
FIG. 13 is a view similar to FIG. 11, showing the parts after rotation of the key.

Referring to FIGS. 9 and 13, when the key 29 of FIG. 6 is inserted into the keyway 23 and then rotated counterclockwise throughout an angle of 90°, the first switch 40-1, the third switch 40-3, the fourth switch 40-4, the fifth switch 40-5, the seventh switch 40-7, the eighth switch 40-8, the ninth switch 40-9 and the tenth switch 40-10 are unerringly closed, although the second switch 40-2 and the sixth switch 40-6 positively remain open. This is due to the fact that the key 29 of FIG. 6 has only eight operating projections 39, that is to say, both the second projection 39-2 and the sixth projection 39-6 are eliminated. On the contrary, all of the ten switches 40-1 to 40-10 are closed when using the key 29 of FIG. 5. For example, in the case of the first switch 40-1, as the first projection 39-1 is fitted in the groove **45*a* of the disk 42 as shown in FIG. 10, the disk 42 is rotated together with the elongated plug portion 16 when the key 29 is turned. While the tongue 57 of the moving contact always touches the stationary contact 47, the other tongue 56 of the contact 51 firstly touches the other stationary contact 48 when the disk 42 is rotated through an angle of 90°, as shown in FIG. 12. In the case of the second switch 40-2, as the key 29 is fitted only in the keyway 23 of the elongated plug portion 16, the disk 42 cannot rotate through any angle, so that the tongue 56 of the moving contact 51 remains in the "OFF" position as shown in FIG. 13**.

Figure 35:
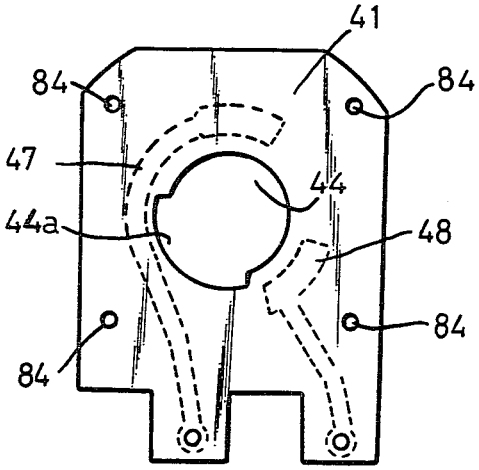
FIG. 35 is a front view of a base plate of another form to be used in the switch.
Figure 36:
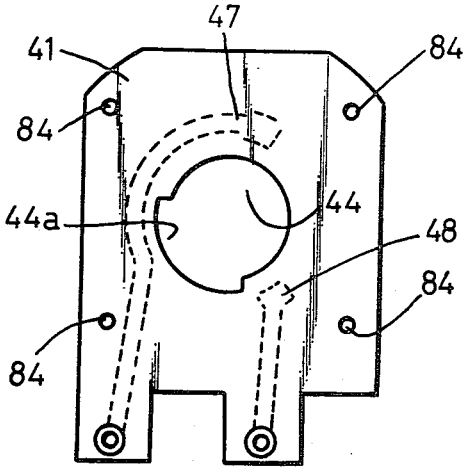
FIG. 36 is a front view of a base plate to be built in the rearmost switch of the assembly.

Referring to FIGS. 35 and 36, the stationary contacts 47, 48 of the tenth switch 40-10 are spaced apart more than the stationary contacts 47, 48 of any other switches, so that the contact tongue 56 of the tenth switch 40-10 comes to the "ON" position at the last stage of the rotation of the key 29. In the present embodiment, the tenth switch 40-10 is closed at the rotation angle of 90°, and the other switches are closed at the rotation angle of 75°. Thus, the tenth switch can be used as a main or master switch. It is to be noted that a large number of different keys 29 are possible by appropriate choice of the number and location of the operating projections 39. A tumbler lock of disk tumbler type is also used in place of the lock 10 of pin tumbler type.

According to the invention, there is easily provided an improved key operated switch lock assembly of high reliability whose component switches are positively closed in reponse to a given rotation of the key selectively, because all of the component switches are of rotary switch type. In the present rotary switch, the rotary disk having a moving contact is rotated together with the key without any delay or advance. It is, therefore, not necessary to test all of the switches to be assembled. As a sampling inspection is only required, it is possible to simplify the manufacturing process so that the efficiency of manufacture of the assembly can be easily increased.

The invention is not to be limited to the exact arrangement of parts shown in the accompanying drawings or described in the specification with reference thereto, because various changes in details of construction may be resorted to without departing from the scope of the invention as defined in the following claims.

What we claim is:

1. A key operated switch lock assembly comprising a lock housing, a lock plug rotatably mounted in the housing and having an axial keyway, said plug including an elongated portion protruding rearward of the housing, a plurality of tumblers slidably mounted on the plug and in the housing, a key insertable into the keyway for permitting rotation of the plug, said key having an elongated portion insertable into the elongated plug portion, said elongated key portion having at least one operating projection on a longitudinal side edge thereof which protrudes out of the keyway, and a plurality of switches secured to the lock housing and selectively operated by the operating projection when the key is rotated, said switch lock assembly being characterized by the construction in which:

(A) said switch is of rotary type and comprises a casing, a base plate, a rotary disk interposed between the casing and the base plate, and a detent for the rotary disk, the casing, the base plate and the disk having respective central apertures in which the elongated plug portion is rotatably fitted, both the casing and the base plate having a sectorial cutout at the edge of the central aperture which permits free rotation of the operating projection of the key, said disk having a groove engaging the operating projection for permitting rotation of the disk together with the key;

(B) the base plate having at least one stationary contact of arch shape around the central aperture, the rotary disk having a moving contact which comes into contact with the stationary contact when the disk is rotated.

* * * * *